US005092534A

United States Patent [19]

Tanaka

[11] Patent Number: 5,092,534

[45] Date of Patent: Mar. 3, 1992

[54] TENSIONING APPARATUS

[75] Inventor: Tomomasa Tanaka, Kamakura, Japan

[73] Assignee: Tanaka Seiki Co., Ltd., Tokyo, Japan

[21] Appl. No.: 612,990

[22] Filed: Nov. 15, 1990

[51] Int. Cl.[5] ..... B65H 59/16

[52] U.S. Cl. ..... 242/155 M

[58] Field of Search ..... 242/155 M, 155 R, 147 R, 242/147 M, 150 R, 150 M, 156, 156.2, 75.2, 75.4, 75.43

[56] References Cited

U.S. PATENT DOCUMENTS

| | | | |
|---|---|---|---|
| 3,022,025 | 2/1962 | Saxl | 242/155 M |
| 3,113,746 | 12/1963 | Steen | 242/155 M |
| 4,526,329 | 7/1985 | Takeda | 242/155 M |

FOREIGN PATENT DOCUMENTS

| | | |
|---|---|---|
| 285204 | 10/1988 | European Pat. Off. . |
| 1216745 | 5/1966 | Fed. Rep. of Germany . |
| 3436187 | 5/1985 | Fed. Rep. of Germany . |
| 8713749 | 1/1988 | Fed. Rep. of Germany . |
| 8713752 | 1/1988 | Fed. Rep. of Germany . |
| 11270 | 12/1983 | Japan . |
| 22194 | 10/1984 | Japan . |
| 48609 | 5/1985 | Japan . |
| 11419 | 8/1987 | Japan . |
| 11420 | 9/1987 | Japan . |

*Primary Examiner*—Stanley N. Gilreath
*Attorney, Agent, or Firm*—Spencer & Frank

[57] ABSTRACT

A tensioning apparatus for setting and controlling the level of a tension on a wire in a coil winding machine. The apparatus includes a rotatable main tension pulley which applies a tension to the wire, a magnet brake for applying a braking torque to the main pulley, and an auxiliary tension pulley contacting a portion of the wire on the downstream side of the main tension pulley as viewed in the direction of movement of the wire. A rotationally urged tension bar having one end rotatably carrying the auxiliary tension pulley is rotationally urged by a spring in such a direction as to tense the wire, thereby resiliently absorbing a variation in the tension of the wire. The apparatus further comprises a brake force adjusting mechanism for adjusting the effect of the magnet brake, and a back tension adjusting mechanism for adjusting the force of the spring to enable adjustment of the urging force acting on the tension bar. The brake force adjusting mechanism has an adjusting portion which is actuated and controlled by a brake force adjusting stepping motor. The back tension adjusting mechanism also is actuated and controlled by a stepping motor. These motors are controlled by a control circuit so as to maintain a set level of the tension on the wire during winding.

6 Claims, 6 Drawing Sheets

PRIOR ART

TENSIONING APPARATUS

BACKGROUND OF THE INVENTION

1. Field of the Invention

The present invention relates to a tensioning apparatus for imparting a constant tension to a wire such as a wire to be wound on a solenoid coil by a coil winding machine. More particularly, the present invention is concerned with a tensioning apparatus which can vary and set the level of tension freely by using an electric motor.

2. Description of the Related Art

Tensioning apparatus of the kind described are used in, for example, a coil winding machine for the purpose of imparting a constant level of tension to a wire which is being unwound from a supply bobbin and wound on a coil bobbin.

An example of such a known tensioning apparatus is shown in FIG. 8.

The tensioning apparatus for a coil winding machine generally has a main body 110 which includes a main tension pulley (brake pulley) 114 which produces a braking torque, a swingable tension bar 115 for absorbing any fluctuation of the tension on the wire, and a pulley 117 provided on the free end of the tension bar 115. In operation, a predetermined level of tension is applied to the wire by cooperation between the main tension pulley 114 and the pulley 117. The main tension pulley 114 has a braking device which exerts a braking torque on the main tension pulley 114. The braking device includes a disk rotatable as a unit with the main tension pulley 114 and a band brake which acts on the outer periphery of the disk. The braking torque is adjustable by a mechanical control of the contact pressure between the band brake and the disk.

It is to be understood, however, that the pressure exerted by the band brake varies during long use of the brake.

It is therefore a current measure to apply the braking torque to the main tension pulley in a non-contact manner by means of a magnet and a magnetic disk which oppose each other. With this arrangement, the level of the braking torque can be freely set by adjusting the distance between the magnet and the magnetic disk.

This type of tensioning apparatus is shown in, for example, Japanese Patent Publication No. 11270/1988, Japanese Utility Model Publication No. 48609/1988, Japanese Patent Publication No. 22194/1989, Japanese Utility Model Publication No. 11419/1990 and Japanese Utility Model Publication No. 11420/1990.

A wire 103 which has passed the main tension pulley 114 is taken up by a bobbin 102 which is rotated at a high speed by a winding machine 101, through an idle pulley 118, the pulley 117 provided on the free end of the tension bar 115, an idle pulley 104 and a nozzle 105.

During the winding, the nozzle 105 is moved to the left and right as viewed in the drawing.

The tension bar 115 is swingable about a fulcrum of an axle 111 of the tension bar 115 and is urged in the clockwise direction by the force of a back tension spring 112 so as to pivot in accordance with the level of the tension thereby absorbing variations in the back tension, thus maintaining a constant level of tension at the position where the wire is wound.

The back tension exerted by the tension bar 115 is changeable or adjustable by replacing the tension spring or by changing the position of the tension spring after removal of the housing cover or by means of an externally operable knob.

The above-described tensioning device has a drawback in that a manual adjustment is necessary each time the specifications of the winding is changed, requiring laborious work for adjusting the level of the braking torque applied to the main tension pulley and adjustment of the back tension applied to the tension bar.

The necessity for the manual adjusting operations tremendously impedes the production efficiency of the conventional automatic coil winding apparatus in which a plurality of coils are wound at a time.

Another drawback of the conventional apparatus is that it has no means for amending any variation in the tension, when necessary, during the winding operation.

SUMMARY OF THE INVENTION

Accordingly, it is a primary object of the present invention to provide a tensioning apparatus in which the braking torque applied to the main tension pulley and the back tension are automatically adjusted and set to desired levels in accordance with winding specifications by an adjusting motor, when the power is turned on or when the tension level is to be changed during the winding.

Another object of the present invention is to provide a tensioning apparatus which is capable of amending any variation in the tension of the wire, when necessary, during winding.

To these ends, according to the present invention, there is provided a tensioning apparatus comprising: a rotatable main tension pulley on which a wire pulled out from a source is wound and which applies a tension to the wire; a magnet brake for applying a braking torque to the main pulley; a rotatable auxiliary tension pulley disposed so as to be contacted and rotated by a portion of the wire between the main tension pulley and the wire pulling end which is on the downstream side of the main tension pulley as viewed in the direction of movement of the wire; a tension bar having one end rotatably carrying the auxiliary tension roller and rotationally urged by a spring in such a direction as to tense the wire, thereby resiliently absorbing a variation in the tension of the wire; a brake force adjusting mechanism for adjusting the effect of the magnet brake; a back tension adjusting means for adjusting the force of the spring so as to adjust the urging force on the tension bar; a brake force adjusting motor for actuating an adjusting portion of the brake force adjusting mechanism thereby enabling adjustment of the brake force; and control circuit means for setting the brake force to a desired level and for detecting the level of the brake force, the control circuit means being capable of controlling the motor so as to actuate the adjusting portion of the brake force adjusting mechanism to a position corresponding to the set level of the tension.

The back tension adjusting mechanism includes a back tension adjusting motor for moving a movable adjusting member for adjusting the force of the spring, and the control circuit means is designed to be capable of setting the back tension to a desired level and detecting the level of the back tension and also capable of controlling the back tension adjusting motor to move the movable adjusting member of the back tension adjusting mechanism to a position corresponding to the set level of the back tension.

The control circuit means includes: a terminal for enabling setting of the back tension; an input terminal for receiving an output from a back tension sensor for sensing the level of the back tension; and a circuit for controlling the operation of the brake force adjusting motor such that the output from the back tension sensor coincides with the set back tension.

The back tension adjusting mechanism includes a motion converting mechanism capable of converting the rotational output of the back tension adjusting motor into a linear motion. The motion converting mechanism is of the type which converts the direction of axis of rotation, such as a combination of a worm gear and a worm wheel.

DESCRIPTION OF THE PREFERRED EMBODIMENTS

Figure 1:
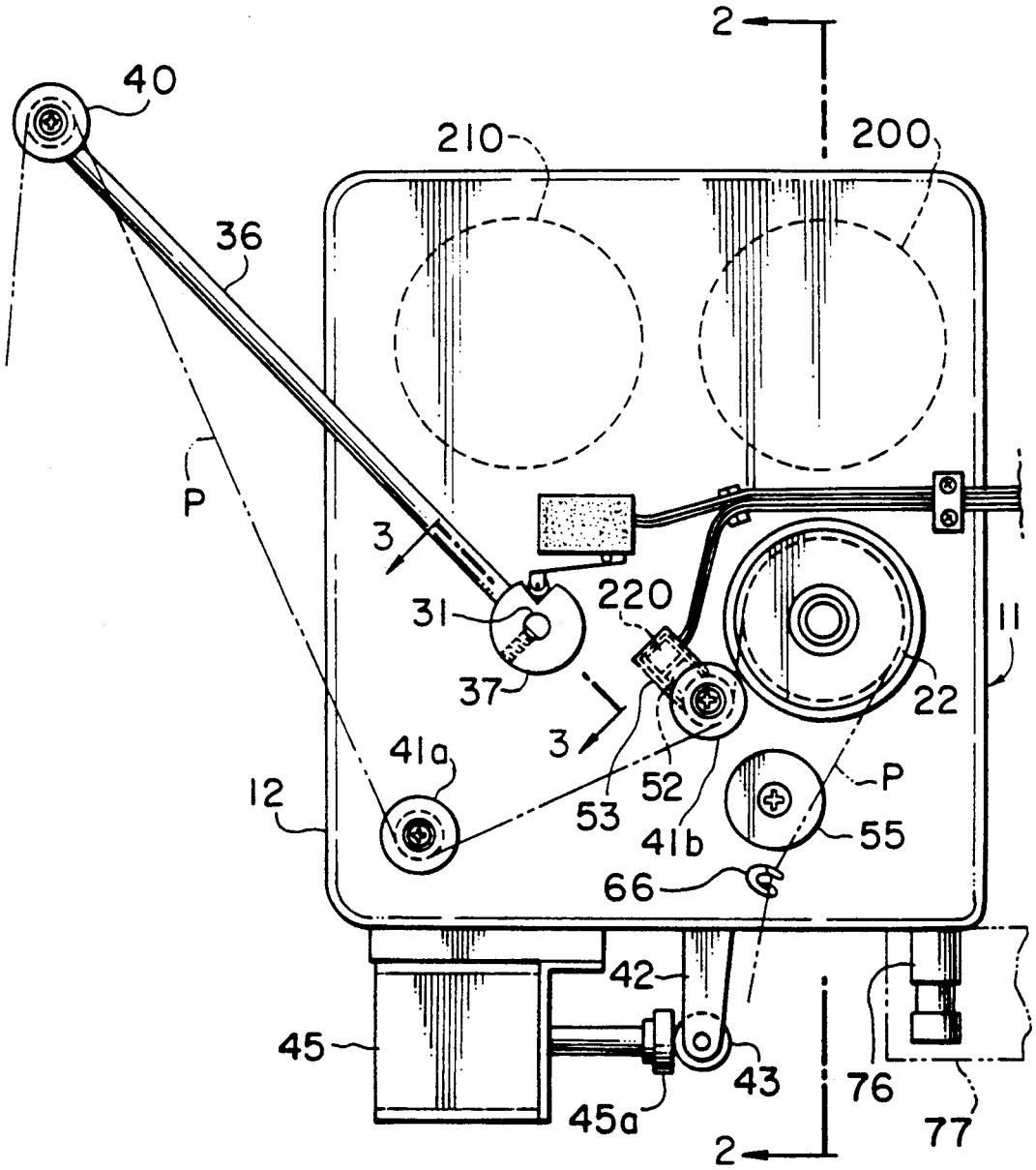
FIG. 1 is a front elevational view of an embodiment of the tensioning apparatus in accordance with the present invention.

A preferred embodiment of the present invention will be described with reference to the accompanying drawings.

The outline of the embodiment will be described first with specific reference to FIGS. 1 and 2.

A pneumatic cylinder 45 and a mounting shaft 76 are attached to the lower surface of the main body 11 of the tensioning apparatus.

The mounting shaft 76 is used for mounting the main body 11 on a coil winding machine which is not shown. More specifically, the mounting shaft 76 is partly embedded in the bottom wall of the main body 11 and is received in a bore formed in a mounting bracket 77 fixed to the coil winding machine.

The front surface of the main body 11 is covered by a front cover 12 on which are mounted a wire presser 55, a main tension pulley 22, auxiliary tension pulleys 41*a*, 41*b*, a microswitch, a snell guide 66 and an auxiliary tension pulley 40 on the end of a tension bar 36.

The snell guide 66 is adapted for guiding a wire P from a supply bobbin (not shown) to the tensioning apparatus.

The wire P supplied from the supply bobbin is guided by the snell guide 66 and is led to the main tension pulley 22 through the wire presser 55 so as to be wound around the main tension pulley 22. A braking torque is applied to the main tension pulley 22 by an electromagnetic brake.

The wire P is then led through auxiliary tension pulleys 41*b*, 41*a* and, after making a turn around the auxiliary tension pulley 40 on the tension bar 36, taken up by and wound on a coil bobbin which is driven by the coil winding machine (not shown).

The tension bar 36 is adapted for absorbing any variation in the tension acting on the wire P, while the auxiliary tension pulleys 41*a*, 41*b* are adapted for changing the direction of movement of the wire P so as to increase the lengths of the portions of the wire P wound around the main tension pulley 22 and the auxiliary tension pulley 40.

A stepping motor 200 incorporated in the main body 11 is adapted for adjusting the braking force which acts on the main tension pulley 22, while a stepping motor 210 is adapted for adjusting the rotational urging force exerted on the tension lever 36.

The tension acting on the running wire P is sensed by a pressure sensor 220. More specifically, the pressure sensor 220 senses any movement of the auxiliary pulley 41*b* from the neutral position so as to measure the pressure which acts on this pulley 41*b* and which indicates the tension acting in the wire P.

A description will now be given of the detail of the major parts of the apparatus, as well as operations of such major parts.

The wire presser 55 clamps the wire P between pads so as to lead the wire P guided by the snell guide 66 towards the main tension pulley 22 thereby preventing the wire P from coming off the main tension pulley 22 and any slack of the wire P. The force with which the wire presser 55 presses the wire can be adjusted freely by rotating an adjusting nut which is not shown.

The braking force is generated through a cooperation between a permanent magnet 48 and a magnetic disk 49 which opposes the magnet 48.

Figure 2:
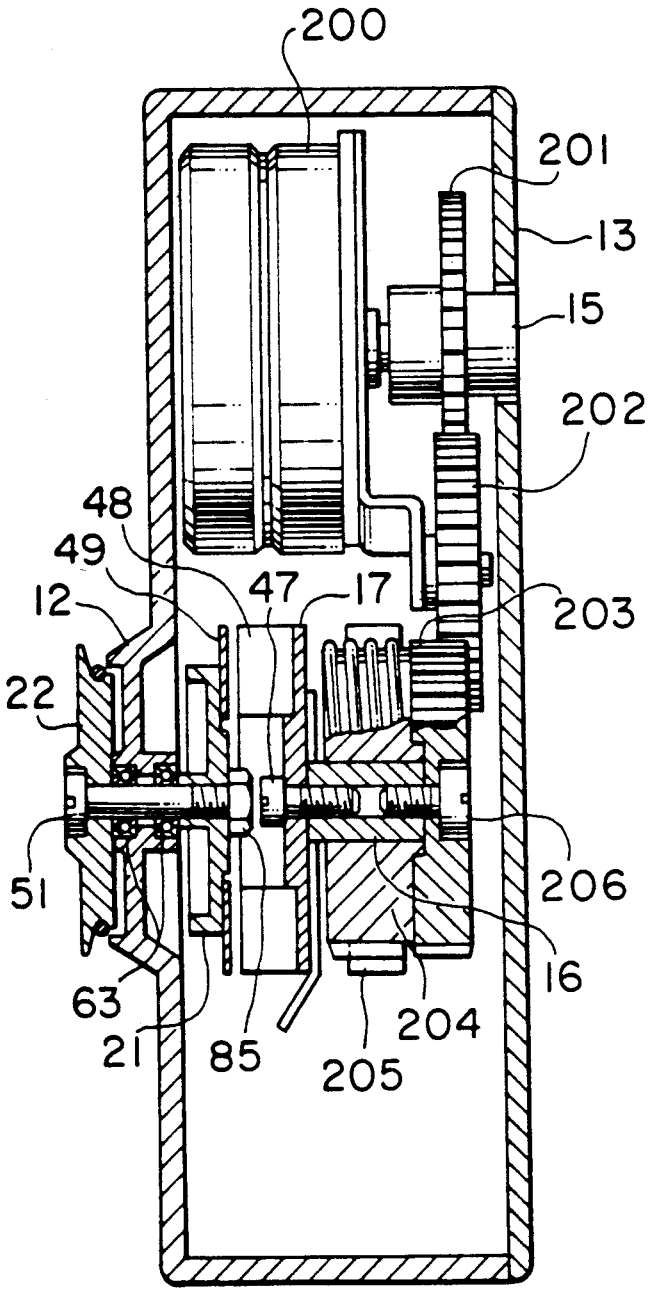
FIG. 2 is a sectional view taken along the line 2—2 of FIG. 1.

As shown in FIG. 2, the main tension pulley 22 is fixed to a disk base plate 21 by means of a base plate fixing screw 51 and a nut 85. The above-mentioned magnetic disk 49 is fixed to the disk base plate 21 so that the magnetic disk 49 rotates as a unit with the main tension pulley 22. The main tension pulley 22 and the magnetic disk 49 are rotatably supported by radial bearings 63, 63 provided on the front cover 12, so that the unitary structure including the main tension pulley 22 and the magnetic disk 49 smoothly rotates with respect to the front cover 12.

On the other hand, the permanent magnet 48 opposing the magnetic disk 49 is fixed by bonding to a magnet pole base plate 17 which in turn is fixed to a magnetic pole shaft 16 by means of a magnet pole base plate fixing screw 47.

Figure 6:
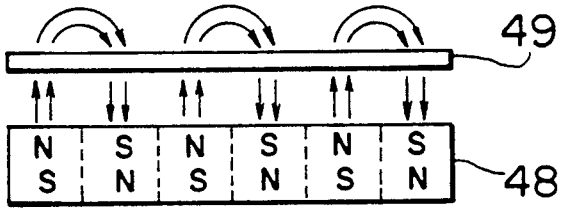
FIG. 6 is an illustration of the positional relationship between a magnet and a magnetic disk.
Figure 8:
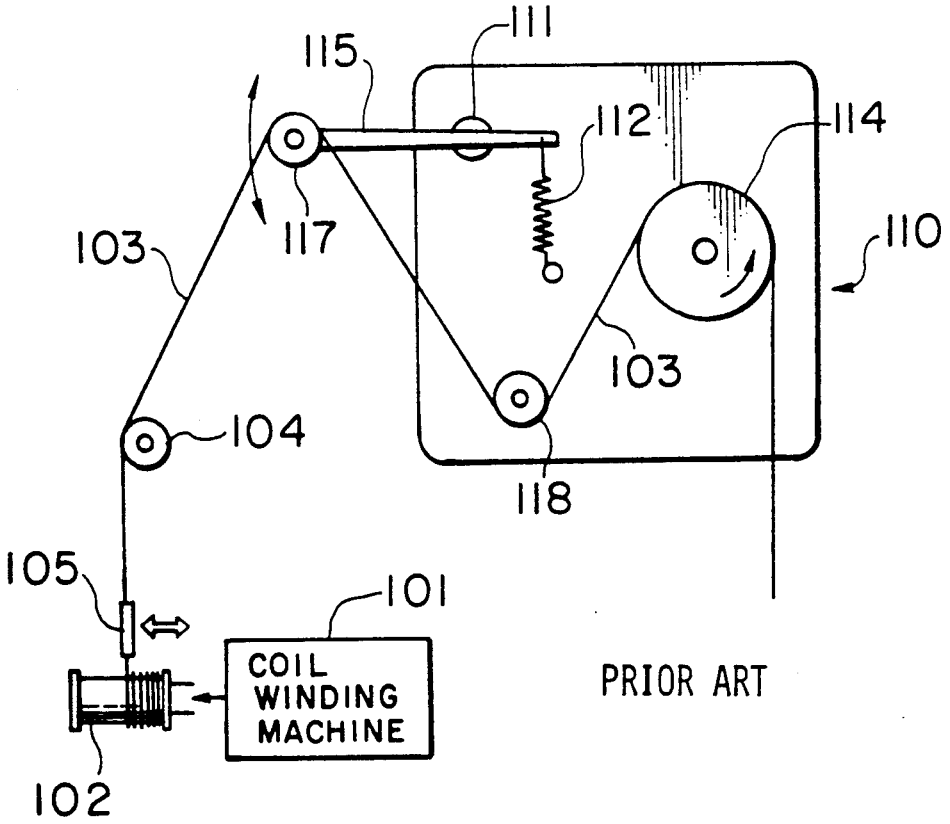
FIG. 8 is an illustration of the basic arrangement of a known tensioning apparatus used in an ordinary coil winding machine.

FIG. 6 shows the relationship between the magnet and the magnetic disk for generating the braking force. The magnet and the magnetic disk are shown in an exploded view exploded around the axis of rotation.

As will be seen from FIG. 6, the permanent magnet 48 has a plurality of permanent magnet pole pieces of N and S polarities arranged alternatingly in the circumferential direction. Alternatingly, a ring-shaped ferromagnetic member is magnetized to provide the magnetic poles shown in FIG. 6.

In operation, an eddy current is generated in the magnetic disk 49 under the influence of the magnetic N and S poles of the permanent magnet 48, whereby a braking torque is generated between the permanent magnet 48 and the magnetic disk 49.

The level of the braking torque is determined by the size of the gap between the permanent magnet 48 and the magnetic disk 49. The setting of the torque, therefore, is conducted by displacing the permanent magnet 48 towards and away from the magnetic disk 49.

A gear 203 is fixed to the magnet pole shaft 16 by means of a gear mounting screw 206. The gear 203 is driven by a gear 201 fixed to the shaft of the stepping motor 200 through an idle gear 202.

On the other hand, a torque adjusting ring 204 is rotatably supported through a screwing engagement by a torque adjusting ring support frame 205 which is fixed to the main body 11. This torque adjusting ring 204 also is fixed to the magnetic shaft 16.

By rotating the torque adjusting ring 204 through the operation of the stepping motor 200, therefore, it is possible to move the permanent magnet 48 towards and away from the magnetic disk 49, thereby adjusting the size of the gap between the permanent magnet 48 and the magnetic disk 49.

Figure 7:
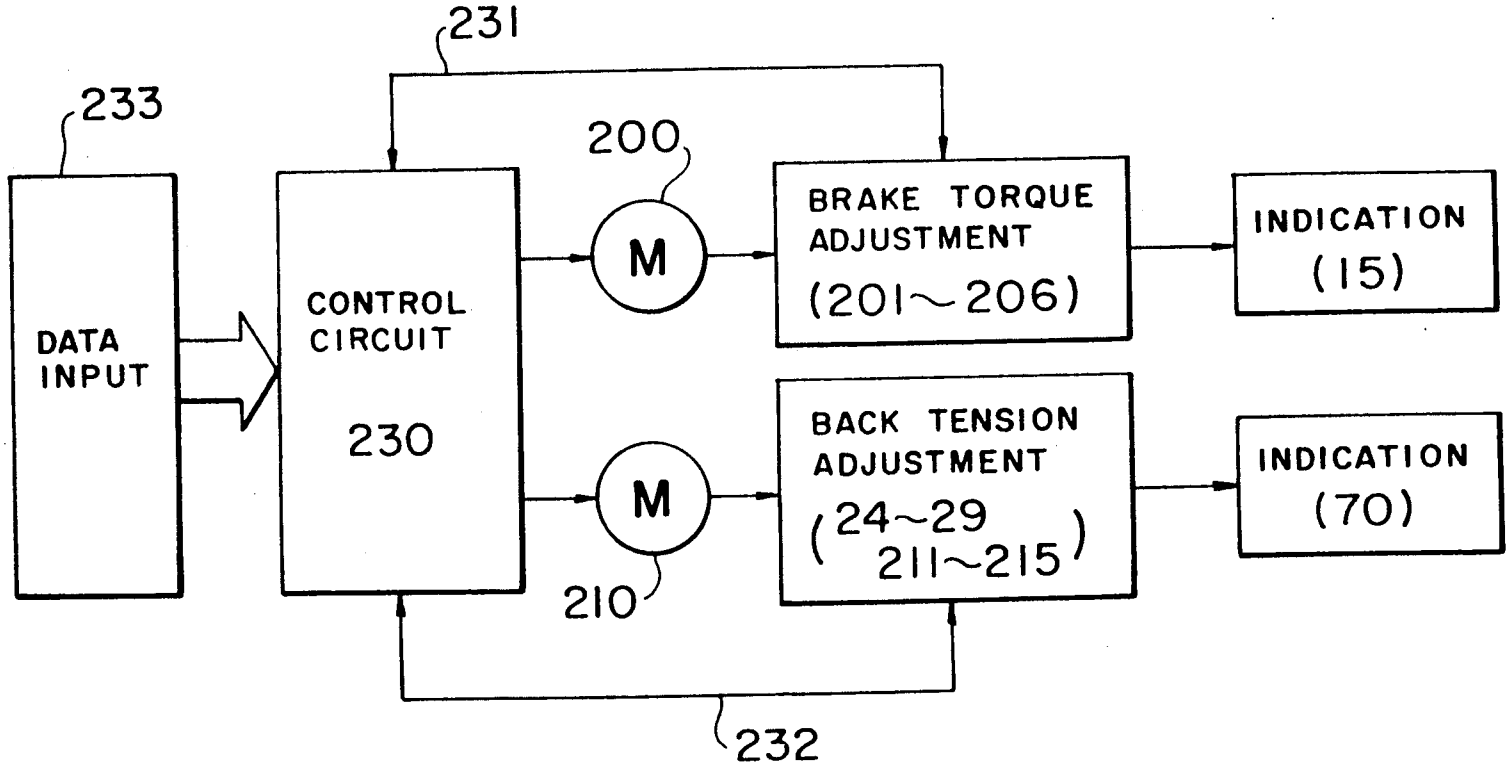
FIG. 7 is a block diagram of the circuit of a tensioning apparatus embodying the present invention.

The control of the stepping motor 200 is conducted through a control section or circuit 230 (see FIG. 7). When the power is turned on, the stepping motor 200 is reversed to move the permanent magnet to an initial position and is then operated to set the permanent magnet to a position determined by the specifications of the coil winding.

The detection of the above-mentioned initial position is conducted by sensing a change in the output of a sensor (not shown) which detects the size of the gap between the permanent magnet 48 and the magnetic disk 49 or by de-synchronization of the stepping motor 200.

A description will now be given of the arrangement for imparting back tension to the wire P which is being pulled out from the supply bobbin.

As shown in FIG. 1, the auxiliary tension pulley 40 for imparting or adjusting the back tension is secured to the end of the tension bar 36 by means of a pulley mounting piece and a radial bearing which are not shown. A tension shaft 31 is fixed to a tension bar ring 37 which in turn is fixed to the other end of the tension bar 36.

Figure 3:
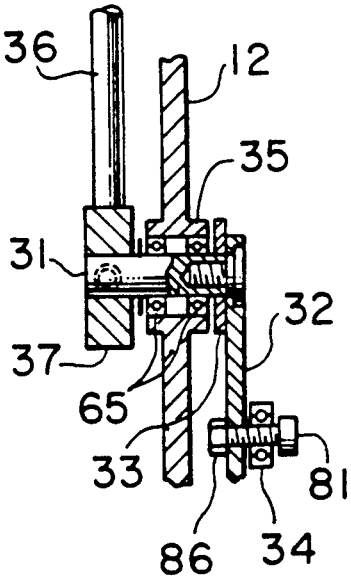
FIG. 3 is a sectional view taken along the line 3—3 of FIG. 1.

The tension shaft 31 is rotatably supported on a tension shaft seat 35 provided on the front cover 12 through radial bearings 65, 65 as shown in FIG. 3. A tension lever 32 is fixed at its one end to the inner end of the tension shaft 31 through a tension lever ring 33. Therefore, the tension bar 36, the tension shaft 31 and the tension lever 32 rotate as a unit with each other.

Figure 4:
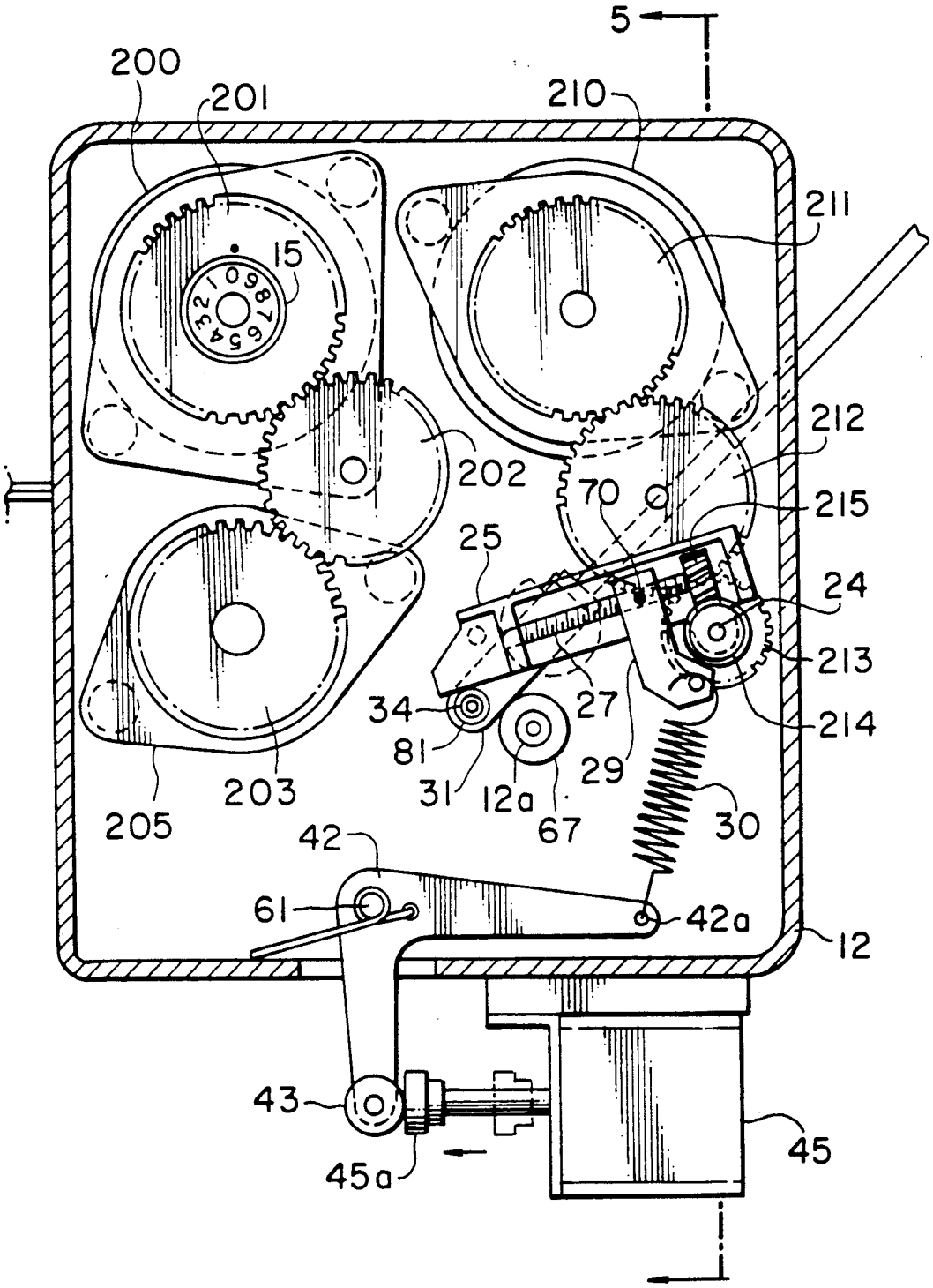
FIG. 4 is a rear elevational view of the embodiment shown in FIG. 1 with a rear lid removed therefrom.

A contact roller 34 is secured to the other end of the tension lever 32 by means of a screw 81 and a nut 86. As will be seen from FIG. 4, the contact roller 34 is always held in contact with the lower surface of a swing lever 25. FIG. 4 shows a state in which no tension is applied at all to the wire P.

The swing lever 25 is swingably supported by a lever shaft 24 provided on the inner surface of the front cover 12, through radial bearings 64 (FIG. 5), so as to swing about a fulcrum constituted by the lever shaft 24. A movable spring retainer nut 29 is screwed to an adjusting screw 27 which is supported by the frame of the swing lever 25. The spring retainer nut 29 is urged downwardly as viewed in FIG. 4 by an adjusting spring 30, so that the swing lever 25 is always urged counter-clockwise as viewed in FIG. 4.

Counter-clockwise swinging of the swing lever 25, however, is limited because the counter-clockwise rotation of the tension lever 32 also is limited by a rubber stop ring 67 fitted on an inner projection **12*a* provided on the inner surface of the front cover 12**.

The other end of the adjusting spring 30 is retained by a retaining hole **42*a* which is provided in a V-shaped lever 42. The V-shaped lever 42 is swingably supported by a shaft pin 61 provided on the inner surface of the front cover 12 so as to freely swing around this pin 61. In the initial condition of operation, the pneumatic cylinder 45 operates to extend a pneumatic cylinder rod 45*a* as shown in FIG. 4 so as to push a contact roller 43 on the V-shaped lever 42, whereby the V-shaped lever 42 is held at a fixed position. As a consequence, the position of the retainer hole 42*a* formed in the V-shaped lever 42**, i.e., the lower end of the adjusting screw, is fixed.

The detail of the mechanism employing the V-shaped lever is described in detail in Japanese Utility Model Publication No. 48609/1988. In this invention, however, the structure of and around the V-shaped lever 42 does not constitute any feature of the present invention. Thus, the mechanism should be understood merely as being a form for fixing the lower end of the adjusting spring.

Consequently, the force which acts to cause the counter-clockwise swinging of the swing lever 25 is determined solely by the position of the movable spring retainer nut 29 which retains the upper end of the adjusting spring 30. Since the lower end of the swing lever 25 constantly presses the contact roller 34 on the tension lever 32, the level of the back tension imparted to the auxiliary tension pulley 40 is determined by the position of the movable spring retainer nut 29.

The spring retainer nut 29 has a female screw thread to which the adjusting screw 27 is screwed. Therefore, the spring retainer nut 29 moves in the direction of the axis of the adjusting screw 27 when a worm wheel 215 fixed to one end of the adjusting screw 27 is rotated.

The level of the back tension is adjusted as the distance between the spring retainer nut 29 and the lever shaft 24 serveing as the fulcrum is changed. In order to indicate the level of the back tension thus adjusted, marks 70 are painted in a red color on a portion of the movable spring retainer nut 29. These marks are observable from the exterior of a back lid 13.

Figure 5:
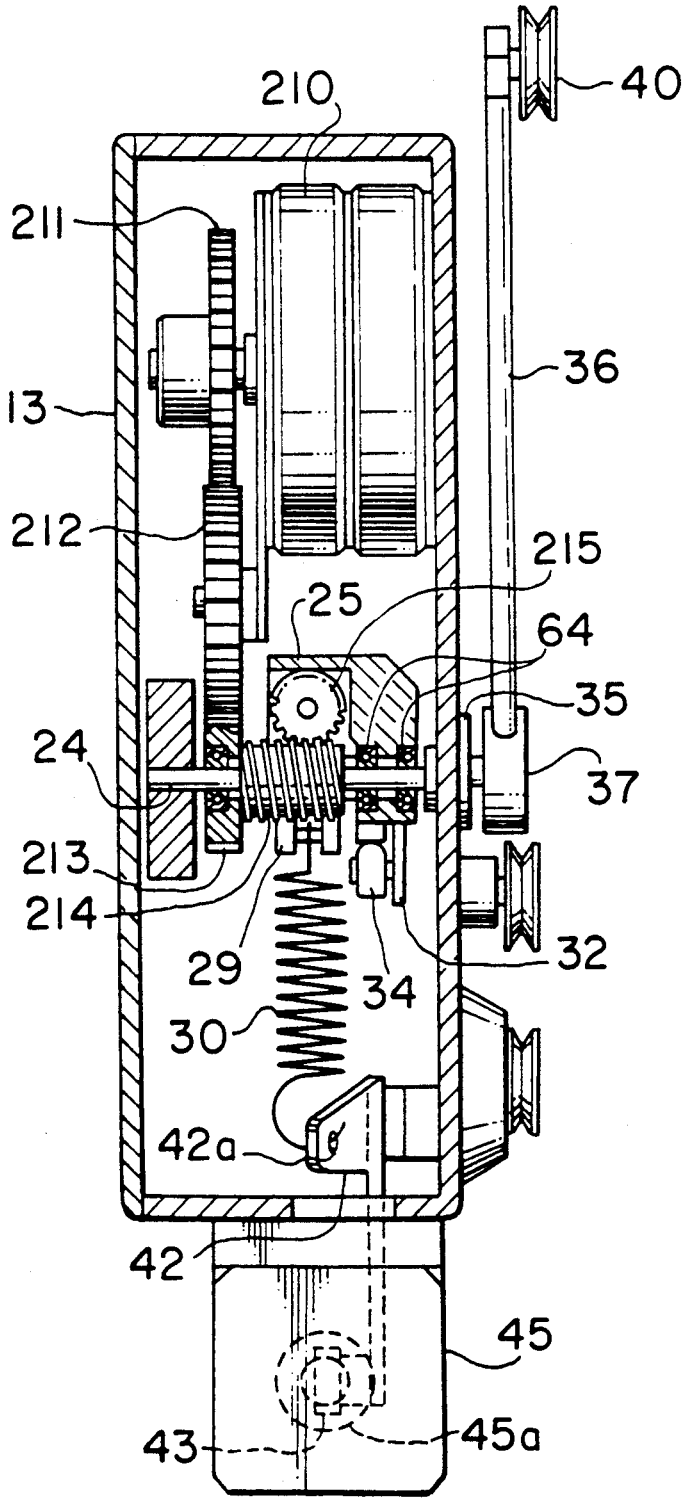
FIG. 5 is a longitudinal sectional view taken along the line 5—5 of FIG. 4.

As will be seen from FIGS. 4 and 5, the worm wheel 215 is rotated by a gear 211 fixed to the shaft of a stepping motor 210, through gears 212, 213 and a worm gear 214.

In the illustrated embodiment, the axis of rotation is turned by the use of the worm gear 214 and the worm wheel 215. This arrangement, however, is only illustrative and the plane of rotation may be changed by using meshing spiral gears. In such a case, the gears may be arranged orthogonally if the diameters of both spiral gears are equal.

Referring to FIG. 4, the adjusting screw 27 is rotated by the stepping motor 210 and causes the movable spring retainer nut 29 to move to the left as viewed in this figure, thereby raising the level of the back tension. Conversely, the back tension is lowered when the spring retainer nut 29 is moved to the right.

The stepping motor 210 is controlled through the controller (control circuit) 230. When the power is turned on, the control circuit operates to reverse the stepping motor 210 so as to reset the movable spring retainer nut 29 to the initial position and then sets the retainer nut 29 to a position determined by the winding specifications in accordance with numerical data which have been input beforehand.

The above-mentioned initial position is detected by measuring a change in the output from a sensor (not shown) such as a photoelectric sensor for detecting the position of the movable spring retainer nut 29 or by a circuit after de-synchronizing the stepping motor 210.

A description will now be given of the method for adjusting the tension of the wire during winding.

When the wire P is pulled in the winding direction, the wire P receives a tension at a level within a predetermined range which is determined by the braking force exerted by the main tension pulley 22 and the back tension applied by the tension bar 36.

A small change in the tension is absorbed as the tension bar 36 delicately swings so as to attain a balance between the tension of the wire P on the auxiliary tension pulley 40 and the urging force applied to the tension bar 36.

The pressure sensor 220 shown in FIG. 1 senses any large tension which cannot be absorbed by the swinging of the tension bar 36.

The pressure sensor 220 is housed in an auxiliary pulley holder guide 53 which is fixed to the front cover 12. The auxiliary pulley 41*b* is fixed to an auxiliary pulley holder 52 which is movable along the inner surface of the auxiliary pulley holder guide 53 towards and away from the portion where the auxiliary pulley 41*b* contacts the wire P.

During initial winding operation, the auxiliary pulley 41*b* lightly contacts the pressure sensor 220. However, when the tension on the wire P is increased, the pressure sensor 220 delivers an output corresponding to the tension to the control section 230, so that the control section 230 operates to control the stepping motor 200 is the direction for reducing the braking force exerted on the main tension pulley 22. As a result, the pressure sensor 220 delivers to the control section 230 an output of a level corresponding to the reduced tension on the wire P, so that the control section 230 operates the stepping motor 200 in the direction which increases the braking force exerted on the main tension pulley 22.

In the described embodiment, the tension on the wire P is controlled in accordance with the output from the pressure sensor 220. This, however, is only illustrative and the control of the tension may be conducted in accordance with an ouput from a photoelectric sensor which detects the position of the tension bar 36 which indicates the level of the back tension.

In order to indicate the instant level of the braking force exerted on the main tension pulley 22, scales are provided in the front surface of a dial 15 fixed to the rotary shaft of the stepping motor 200 so as to be visible from the exterior of the rear lid 13.

FIG. 7 is a block diagram of an electric circuit incorporated in the tensioning apparatus of the present invention. The operator can input necessary data concerning the back tension to the control circuit 230. It will be obvious that wires of greater diameters generally require greater levels of back tension and wires of smaller diameters require lower levels of the back tension because the wire may be cut during the winding by too strong back tension. The control circuit 230 then controls the stepping motor 200 in accordance with the input data so as to set the brake torque to a suitable level and also controls the stepping motor 210 so as to set the back tension spring to a position where it provides a suitable level of back tension.

Data outputs from the sensors are delivered to the control circuit 230 through data lines 231, 232.

The state of the brake torque setting means 201–206 is indicated by dial 15. The position of the back tension spring also is known from the position of the spring retainer nut 29 as indicated by marks 70 for observation from the exterior of the apparatus.

The operation or method of use of the apparatus of the present embodiment is as follows:

The main body of the tensioning apparatus is mounted on and fixed to a coil winding machine (not shown) through the mounting shaft 76. Then, a wire P led from a supply bobbin is threaded through the snell guide 66. Then, the wire P is partly clamped by the line presser 55 and, after making about $\frac{3}{4}$ rotation around the main tension pulley 22, led through the auxiliary tension pulleys 41*a*, 41*b* and then wound around the auxiliary tension pulley 40. A plurality of wires P, corresponding to the number of coils to be formed simutaneously are supplied in the above-described manner.

Subsequently, numerical data concerning the braking force to be applied to the main tension pulley and the back tension to be produced by the tension bar are input to the control section through a manipulating portion in accordance with the coil winding specifications. Then, the coil winding machine is started so that the stepping motors 200, 210 of the tension adjusting mechanisms operate to automatically set the braking force and the back tension to predetermined levels. Any change in the tension applied to the wire P during winding is sensed by the pressure sensor 220 and the control section operates in accordance with the output from the pressure sensor 220 so as to control the stepping motor 200 thereby compensating for such a change in the tension.

As has been described, the present invention provides a tensioning apparatus having a main tensioning pulley which applies a braking force to a moving wire and an auxiliary tension pulley which imparts a back tension to the wire thereby controlling the tension on the wire, wherein the braking torque applied to the main tension pulley and the back tension applied to the lever supporting the auxiliary tension pulley are set to predetermined levels by automatically-controlled stepping motors, thus eliminating troublesome and laborious manual adjusting works which heretobefore have been necessary upon each change of the winding condition, e.g., size of the wire, presence or absence of the sheath on the wire, size of the coil bobbin and form of the coil bobbin.

Thus, the present invention enables a quick and easy adjustment of the tension when the winding specifications are changed. This feature is advantageous particularly in the cases where coil winding has to be conducted on a plurality of coil bobbins simultaneously. Thus, the tensioning apparatus of the present invention makes it possible to improve reliability of the products and efficiency of the winding operation, particularly when combined with an automatic coil winding machine.

Furthermore, any change in the tension incurred during winding can be corrected for, by the control of the braking torque on the main tension pulley which is conducted in accordance with the output from a sensor which senses the tension on the moving wire. This contributes to an improvement in products quality which are to be finished with specifically high grade of quality.

What is claimed is:

1. A tensioning apparatus comprising:

a rotatable main tension pulley on which a wire pulled out from a source is wound and which applies a tension to said wire;

a magnet brake for applying a braking torque to said main pulley;

a rotatable auxiliary tension pulley disposed so as to be contacted and rotated by a portion of said wire between said main tension pulley and the wire pulling out end which is on the downstream side of said main tension pulley as viewed in the direction of movement of said wire;

a tension bar having one end rotatably carrying said auxiliary tension pulley and rotationally urged by a spring in such a direction as to tense said wire, thereby resiliently absorbing a variation in the tension of said wire;

a brake force adjusting mechanism for adjusting the effect of said magnet brake;

a back tension adjusting means for adjusting the force exerted by said spring so as to adjust the urging force on said tension bar;

a brake force adjusting motor for actuating an adjusting portion of said brake force adjusting mechanism thereby enabling adjustment of the brake force; and control circuit means for setting the brake force to a desired level and for detecting the level of the brake force, said control circuit means being capable of controlling said motor so as to actuate said adjusting portion of said brake force adjusting mechanism to a position corresponding to the set level of the tension.

2. A tensioning apparatus according to claim 1, wherein said back tension adjusting mechanism includes a back tension adjusting motor for moving a movable adjusting member for adjusting the force exerted from said spring, and wherein said control circuit means is capable of setting the back tension to a desired level and detecting the level of the back tension and also capable of controlling said back tension adjusting motor to move said movable adjusting member of said back tension adjusting mechanism to a position corresponding to the set level of the back tension.

3. A tensioning apparatus according to claim 2, wherein said control circuit means includes: a terminal for enabling setting of the back tension; an input terminal for receiving an output from a back tension sensor for sensing the level of the back tension; and a circuit for controlling the operation of said brake force adjusting motor such that the output from said back tension sensor coincides with the set back tension.

4. A tensioning apparatus according to claim 2, wherein said back tension adjusting mechanism includes a motion converting mechanism capable of converting the rotational output of said back tension adjusting motor into linear motion.

5. A tensioning apparatus according to claim 4, wherein said back tensioning adjusting motor rotates about a first axis of rotation, and wherein said motion converting mechanism converts said rotational output to linear motion in the direction of a second axis.

6. A tensioning apparatus according to claim 5, wherein said motion converting mechanism includes a worm gear and a worm wheel.

* * * * *